United States Patent [19]

Himmer

[11] 4,322,913

[45] Apr. 6, 1982

[54] AUTOMATIC DOOR FOR PETS

[76] Inventor: Robert D. Himmer, 500 N. Byfield, Westland, Mich. 48185

[21] Appl. No.: 147,836

[22] Filed: May 8, 1980

[51] Int. Cl.[3] ..... E06B 7/28

[52] U.S. Cl. ..... 49/168; 49/169; 49/264; 49/360

[58] Field of Search ..... 49/168, 169, 264, 327, 49/360, 404; 160/180

[56] References Cited

U.S. PATENT DOCUMENTS

| | | | |
|---|---|---|---|
| 1,888,612 | 11/1932 | Anderson | 49/360 X |
| 2,695,574 | 11/1954 | Ceci | 49/264 X |
| 3,039,038 | 6/1962 | Weible | 49/264 X |
| 3,811,224 | 5/1974 | Garrison | 49/168 |
| 3,821,865 | 7/1974 | Steinke | 49/404 |
| 3,878,645 | 4/1975 | Porter | 49/169 |
| 3,938,282 | 2/1976 | Goyal | 49/360 X |
| 4,022,263 | 5/1977 | Beckett et al. | 160/180 X |
| 4,053,007 | 10/1977 | Griffith | 49/168 X |

*Primary Examiner*—Philip C. Kannan
*Attorney, Agent, or Firm*—Charles W. Chandler

[57] ABSTRACT

This invention is related to an automatically opening door for pets, mounted in an opening of a building without requiring changes to the opening structure.

5 Claims, 5 Drawing Figures

AUTOMATIC DOOR FOR PETS

BACKGROUND OF THE INVENTION

This invention is related to automatically opening pet doors, and more specifically to such a door that is vertically raised by a motor when the pet steps on a pressure pad either inside or outside of the door opening.

Pet doors are known in the prior art which can be mounted in a building opening to permit the pet to either leave or enter the building without attention from the owner. For example, such doors are disclosed in U.S. Pat. No. 3,811,224 which issued to Elbert W. Garrison, and U.S. Pat. No. 4,173,099 which issued to Donald Robb. One problem with such doors is that they require training the pet to open the door by pushing against it.

SUMMARY OF THE INVENTION

The broad purpose of the present invention is to provide an automatically operated pet door having a motor connected to the door for raising or lowering it. The motor is energized by the pet stepping on an outside pressure pad or an inside pressure pad.

In one embodiment of the invention, the pet door is mounted in the opening formed by a partially opened horizontally sliding glass door which is common in many buildings. In another embodiment of the invention, the door is mounted on a conventional hinge door. The door can also be mounted in a wall opening.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
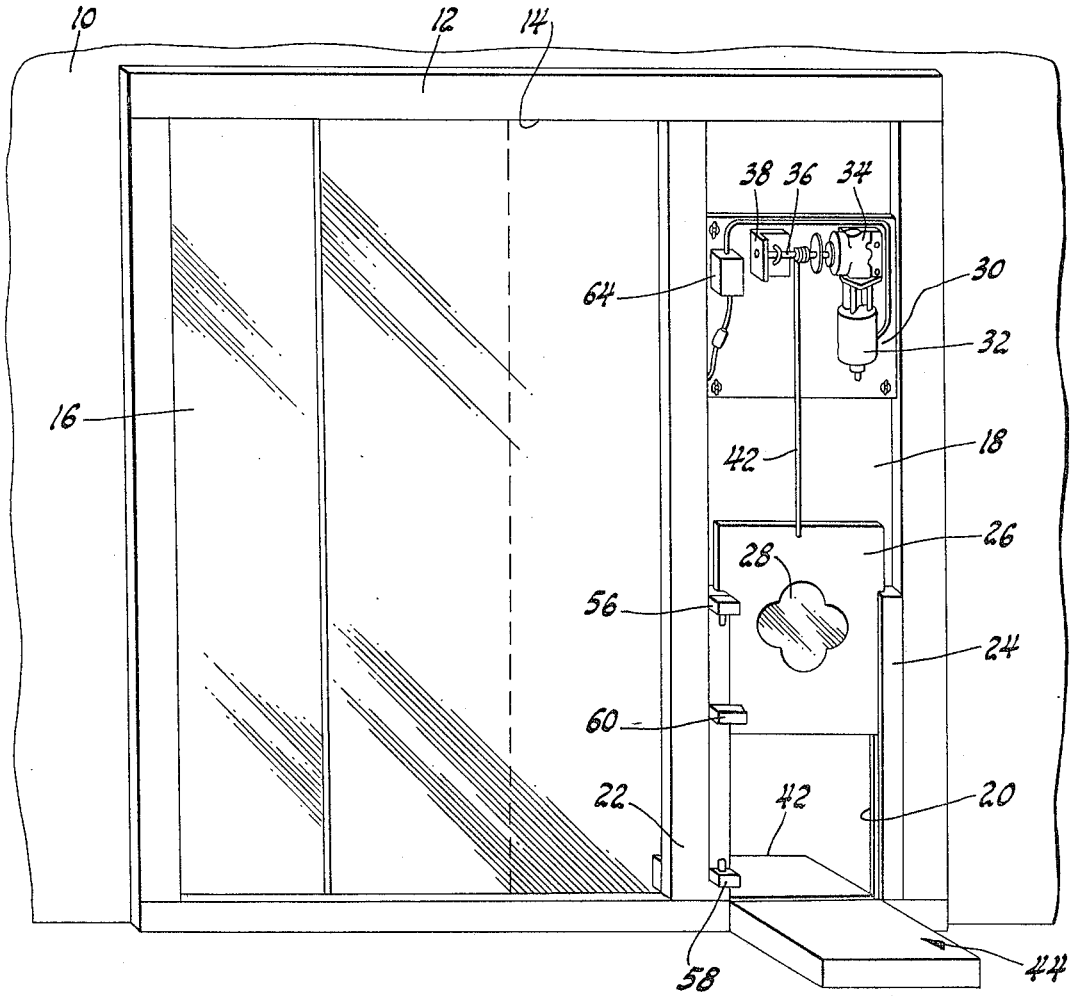
FIG. 1 is a view illustrating the preferred embodiment of the invention as seen from the inside of the residence.

Referring to the drawings, a residential structure is illustrated at 10 in FIG. 1, having frame means 12 defining a conventional door opening 14. A glass sliding door 16 is mounted in opening 14. In FIG. 1, the door is illustrated in a partially open position.

Figure 2:
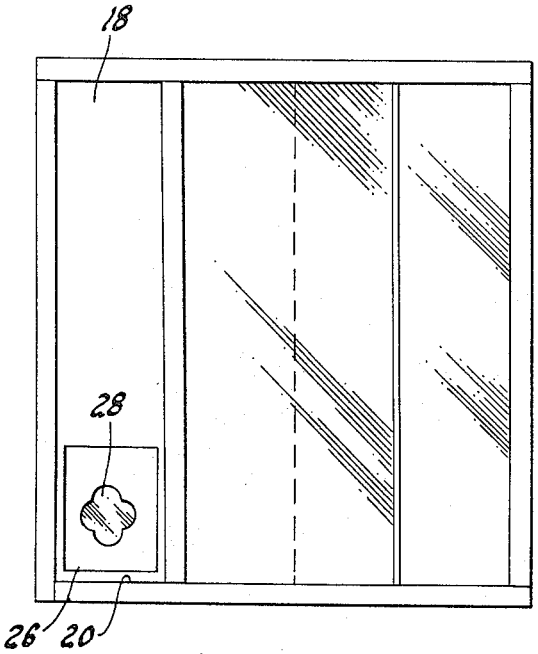
FIG. 2 is a view of the invention as viewed from the outside of the residence.

Referring to FIGS. 1 and 2, an insulated panel 18 is mounted in that portion of opening 14 unblocked by door 16. Panel 18 has a small opening 20 having a size accommodating a pet (not shown). A pair of spaced vertical channels 22 and 24 are mounted on opposite sides of opening 20. A pet door 26, illustrated in a partially open position, is vertically slidably mounted in channels 22 and 24. Door 26 has a small window 28 permitting the pet to view the opposite side of the door opening.

The pet door is movable between a lower closed position, illustrated in FIG. 2, and an upper position. In FIG. 1, the door is illustrated in a partially open position.

A motor mounting panel 30 is mounted above the pet door. An electric motor 32 is mounted on mounting panel 30 and connected through gear box 34 to shaft 36. The opposite end of the shaft is mounted on bearing means 38. The upper end of a flexible line 42 is connected to shaft 36 and the lines lower end is connected to the pet door in such a manner that as the shaft is rotated in one direction, the door is raised, and as it is rotated in the opposite direction, the door is lowered. The direction of shaft rotation is determined by the direction of motor rotation.

Figure 3:
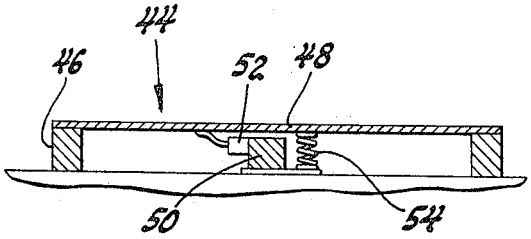
FIG. 3 is a sectional view of one type of pressure pad.

Referring to FIGS. 1, 2, and 3, a pair of floor-mounted pressure pads 42 and 44 are mounted adjacent the door opening. Pressure pad 42 is disposed outside the door opening, and pressure pad 44 is disposed inside the door opening. The two pressure pads are essentially identical in construction. Pressure pad 44 is illustrated in FIG. 3 to show the pressure pad construction which includes a four-sided frame means 46. A relatively thin, flexible board 48 is mounted on frame 46. Frame 46 has a cross member 50. A switch 52 is mounted beneath board 48 so that when the pet steps on the board, it flexes downwardly to actuate the switch. A spring 54 is also mounted adjacent cross member 50 and engages board 48 to bias it upwardly sufficiently to de-activate the switch until such time as the pet steps on the pressure pad.

Referring to FIG. 1, an upper limit switch 56 and a lower limit switch 58 are mounted adjacent the pet door.

An arcuator 60 is carried by the pet door to engage lower switch 58 in the door's lower (closed) position and to engage upper switch 56 in the door's upper (open) position. A control relay 64 is mounted on panel 30 and electrically connected to the upper and lower limit switches.

Figure 4:
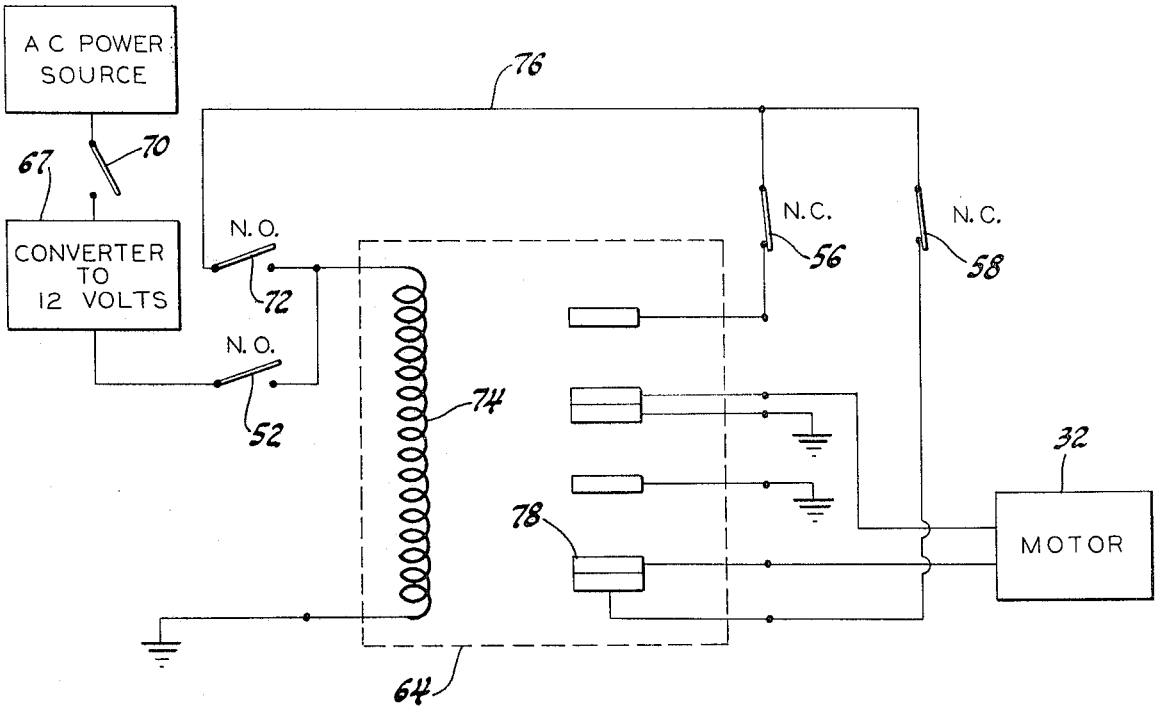
FIG. 4 is an electrical schematic view of the preferred embodiment.

FIG. 4 is a schematic of the electrical connections from a convertor 67. The input of convertor 67 is preceded by on/off switch 70. The inside pressure pad switch 52 is connected in parallel with a second pressure switch 72 mounted on outside pressure pad 42 such that when either of the pressure pad switches is energized, a relay coil 74 is energized. Switches 52 and 72 are normally open switches.

Switches 56 and 58 are connected by connector means 76 so that they are normally closed when the system is energized. When the pet door is in its lower position and either switch 52 or 72 is closed, relay means 78 close to provide power to the motor causing it to rotate to raise the pet door. The door travels upwardly until it engages upper switch 56 which then remains open until both switches 52 and 72 are released to de-energize coil 74. The motor then rotates in the opposite direction thereby lowering the door until actuator 60 engages lower limit switch 58.

Figure 5:
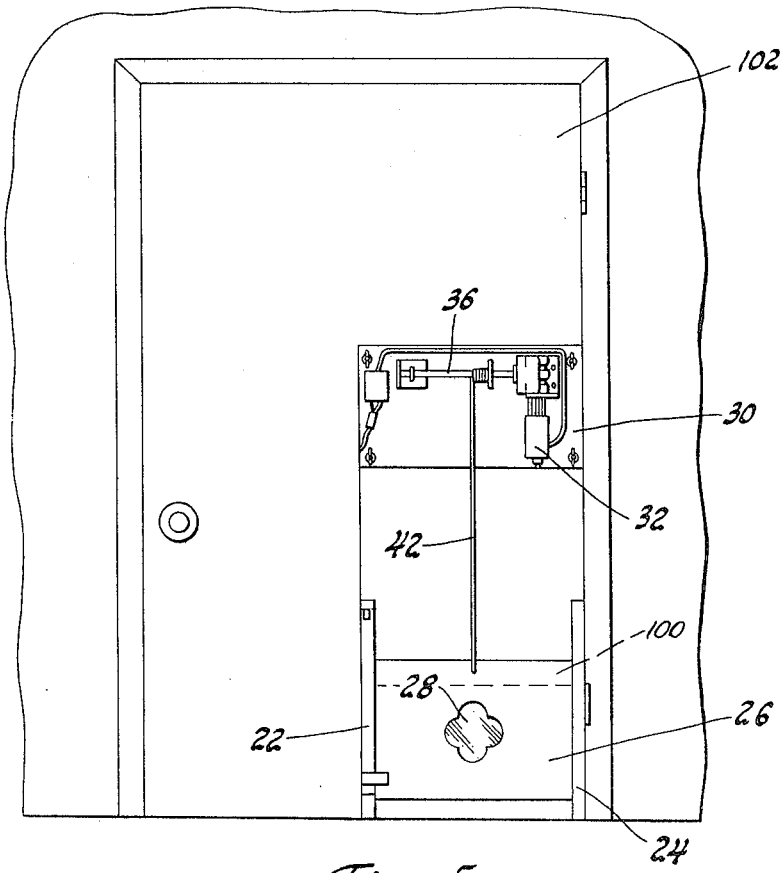
FIG. 5 is a view of another embodiment of the invention mounted on a hinged door.

FIG. 5 illustrates another embodiment of the invention in which pet door 26 is mounted by channels 22 and 24 to an opening formed in a hinged door 102. In this case, mounting panel 30, with motor 32 and shaft 36, are connected by line 42 to the door to raise and lower it in the same manner as illustrated in FIG. 1. Thus the invention is readily adaptable to either a sliding door, a hinged door, or an opening in a wall and provides means for a pet to enter or leave the building without any attention from the owner.

Having described my invention, I claim:

1. In a building having an opening, the combination comprising:

a first, larger door and a second, smaller door, collectively blocking said opening, and means supporting the larger door for motion toward a position in which it unblocks at least a part of said opening;

means mounting the smaller door for vertical sliding motion between a first position in which it unblocks a portion of said opening and a second position in which the smaller door blocks said portion of the opening;

power means connected to the smaller door so as to be operable to move the smaller door from said second position to said first position; and a first floor-mounted pressure pad on a first side of said opening, and a second floor-mounted pressure pad on the opposite side of said opening, and means electrically connecting said pressure pads to said power means whereby each of said pressure pads is operative to energize said power means to move said smaller door from said second position to said first position.

2. A combination as defined in claim 1, including frame means mounted in said opening, said larger door being horizontally slidably movable in said frame means to unblock said opening.

3. A combination as defined in claim 1, including hinge means, the larger door being connected to said hinge means for motion from a position in which the larger door blocks said opening to another position in which the larger door unblocks said opening.

4. A combination as defined in claim 1, in which said power means includes a motor, and said pressure pads are electrically connected to said motor.

5. A combination as defined in claim 1, including a motor and in which said power means includes a shaft mounted above the smaller door, a flexible line connecting the shafts to the smaller door, and means rotatably connecting the motor to the shaft whereby as the motor is actuated, the shaft is rotated to raise said smaller door.

* * * * *